United States Patent [19]

Kohama et al.

[11] 4,196,706

[45] Apr. 8, 1980

[54] EXHAUST GAS RECIRCULATION SYSTEM FOR INTERNAL COMBUSTION ENGINE

[75] Inventors: Tokio Kohama, Nishio; Hideki Obayashi, Aichi; Tadashi Ozaki, Nishio; Hidetaka Nohira, Susono, all of Japan

[73] Assignees: Nippon Soken, Inc., Nishio; Toyota Jidosha Kogyo Kabushiki Kaisha, Toyota, both of Japan

[21] Appl. No.: 871,936

[22] Filed: Jan. 24, 1978

[30] Foreign Application Priority Data

Jan. 26, 1977 [JP] Japan ..... 52-8102

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 4,031,871 | 6/1977 | Hamanishi | 123/119 A |
| 4,041,917 | 8/1977 | Suzuki | 123/119 A |
| 4,057,043 | 11/1977 | Harada | 123/119 A |

*Primary Examiner*—Wendell E. Burns

*Attorney, Agent, or Firm*—Cushman, Darby & Cushman

[57] ABSTRACT

In an exhaust gas recirculation system for an internal combustion engine of the type including an exhaust gas recirculation passage for communicating an exhaust tube with an intake tube downstream of a throttle valve disposed therein for recirculating part of exhaust gases from the exhaust tube into the intake tube, and a control valve for controlling the flow rate of exhaust gases flowing through the recirculation passage, there are provided negative pressure control means responsive to the negative intake pressure downstream of the throttle valve in the intake tube for generating a pressure signal the magnitude of which is in proportion to the load on the internal combustion engine, and a modulator responsive to the pressure in the recirculation passage upstream of the control valve for controlling the pressure signal, whereby the pressure signal which is controlled by the modulator operates the recirculation gas flow rate control valve in such a manner that the volume of exhaust gases to be recirculated may be in proportion to the load on the engine.

6 Claims, 4 Drawing Figures

EXHAUST GAS RECIRCULATION SYSTEM FOR INTERNAL COMBUSTION ENGINE

BACKGROUND OF THE INVENTION

The present invention relates to an exhaust gas recirculation system for an internal combustion engine very effective in reduction of MOx emission.

The conventional exhaust gas recirculation systems may be divided into a plate type and a manifold type. In the former type, exhaust gases from an exhaust tube of an internal combustion engine are recirculated through fixed restriction means into an intake tube between a carburetor and a throttle valve in such a way that the volume of recirculated exhaust gases may be a function of a pressure in the exhaust tube. In the latter type, exhaust gases from the exhaust tube are recirculated through a restriction means into an intake manifold. Both types of the external exhaust gas recirculation systems are very effective in reduction of NOx emission in exhaust gases.

In addition to the external exhaust gas recirculation systems, it has been found that residual gases which remains within the cylinders as a result of the incomplete scavenging have the ability of reducing NOx emission comparable to the external exhaust gas recirculation systems. Therefore both the external exhaust gas recirculation and the residual gases (to be referred to as "internal exhaust gas recirculation") must be taken into consideration in the reduction of NOx and must be optimumly controlled for the attainment of the maximum NOx reduction.

To this end, it is an ideal method to maintain constant the ratio of the volume of the total exhaust gas recirculation (external exhaust gas recirculation + internal exhaust gas recirculation) to the volume of intake air. However, the ratio of the internal exhaust gas recirculation becomes low with a heavy load and high with a light load. Accordingly, the ratio of the external exhaust gas recirculation must be controlled depending upon the load on the engine in such a manner that the ratio of the external exhaust gas recirculation is increased with a heavy load and reduced with a light load.

With the prior art plate type exhaust gas recirculation system, the ratio of the volume of exhaust gases to be recirculated to the volume of intake air can be maintained at a predetermined level, but cannot be varied depending upon the variations in load. Furthermore the plate type exhaust gas recirculation system results in the adhesion of foreign matters to the throttle valve, adverse thermal effects on the carburetor and the icing problem at low temperatures.

In the manifold type exhaust gas recirculation system, the exhaust gases are directly recirculated into the intake manifold so that the adverse effects as encountered in the plate type exhaust gas recirculation system may be avoided. However in the prior art manifold type exhaust gas recirculation system, the volume of exhaust gases to be recirculated is controlled depending upon the negative intake pressure or the negative pressure at a venturi so that the volume of exhaust gases recirculated is dependent upon the difference between the back pressure and the intake pressure and the opening area of restriction means. As a result, the recirculation volume is high with a light load while low with a heavy load especially under the influence of the negative pressure of intake air. That is, the control on the volume of exhaust gases to be recirculated is contrary to the ideal control described above. For this reason with a light load, surging and misfiring result, and with a heavy load NOx emission cannot be reduced to an acceptable degree.

To overcome these problems there has been proposed a modified manifold type exhaust gas recirculation system wherein an exhaust gas recirculation control valve which is responsive to the negative intake pressure which in turn is controlled by a modulator is disposed within an exhaust gas recirculation passage so that the ratio of the volume of externally recirculated exhaust gases to the volume of intake air may be maintained constant. However as with the plate type exhaust gas recirculation system this modified system still cannot control the external exhaust gas recirculation ratio in response to the variations in load.

SUMMARY OF THE INVENTION

The present invention was made to overcome the above and other problems encountered in the prior art exhaust gas recirculation systems.

One of the objects of the present invention is to provide an exhaust gas recirculation system wherein the negative pressure to be admitted through restriction means from an intake tube into a modulator is controlled so as to be proportional to the load, and one of the pressure chambers of the modulator is communicated with the surrounding atmosphere through an inlet port having a restriction means, whereby the external exhaust gas recirculation may be ideally controlled in such a manner that the external exhaust gas recirculation ratio may be increased or decreased as the load is increased or decreased.

The above and other objects, features and advantages of the present invention will become more apparent from the following description of one preferred embodiment thereof taken in conjunction with the accompanying drawings.

BRIEF DESCRIPTION OF THE DRAWINGS

In FIGS. 1 and 2 EGR refers to Exhaust Gas Recirculation.

DESCRIPTION OF THE PREFERRED EMBODIMENT

Figure 1:
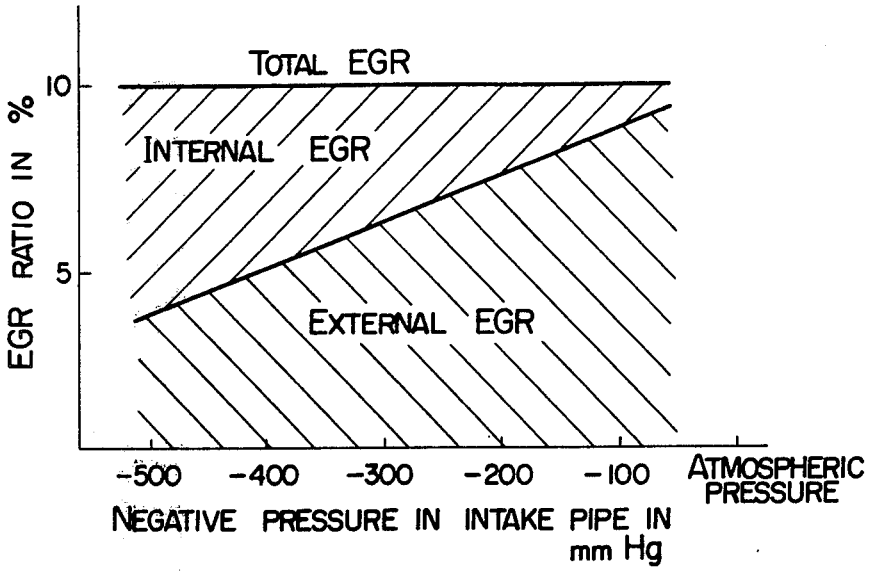
FIG. 1 shows the ideal total exhaust gas recirculation ratio and the ideal ratio between the external and internal exhaust gas recirculations.

For the effective reduction in NOx in exhaust gases from an internal combustion engine over its all load range, it is ideal to maintain constant the ratio of the total volume of recirculated exhaust gases (externally recirculated exhaust gases + internally recirculated exhaust gases) to the volume of intake air independently of the load (which may be represented in terms of the negative pressure in the intake tube) as shown in FIG. 1. However the ratio of the volume of internally recirculated exhaust gases (to be referred to as "internal exhaust gas recirculation ratio") becomes higher with a light load but becomes lower with a heavy load so that the ratio of the volume of the externally recirculated exhaust gases (to be referred to as "external exhaust gas recirculation ratio") must be so controlled as to be low with a light load and high with a heavy load as shown in FIG. 2.

Figure 2:
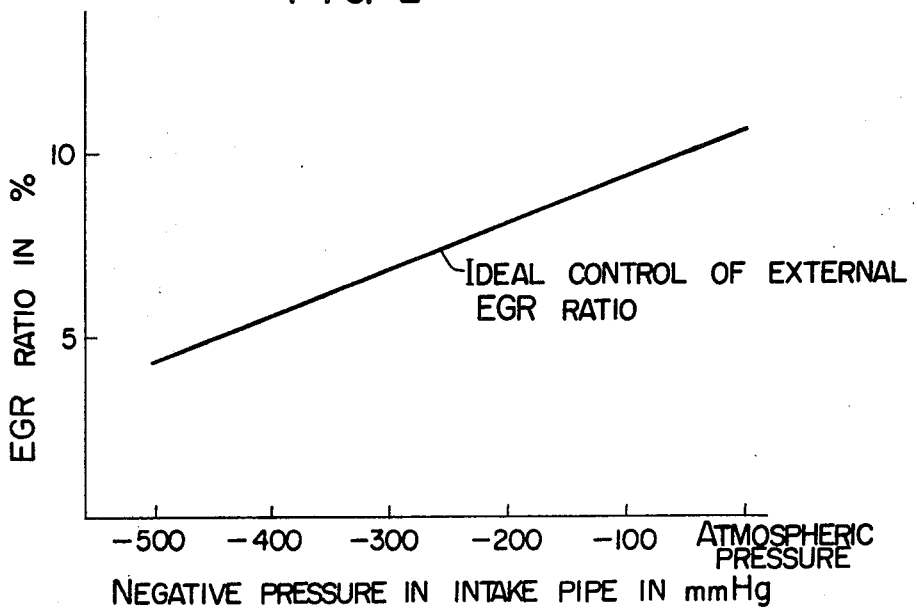
FIG. 2 shows the ideal external exhaust gas recirculation ratio.
Figure 3:
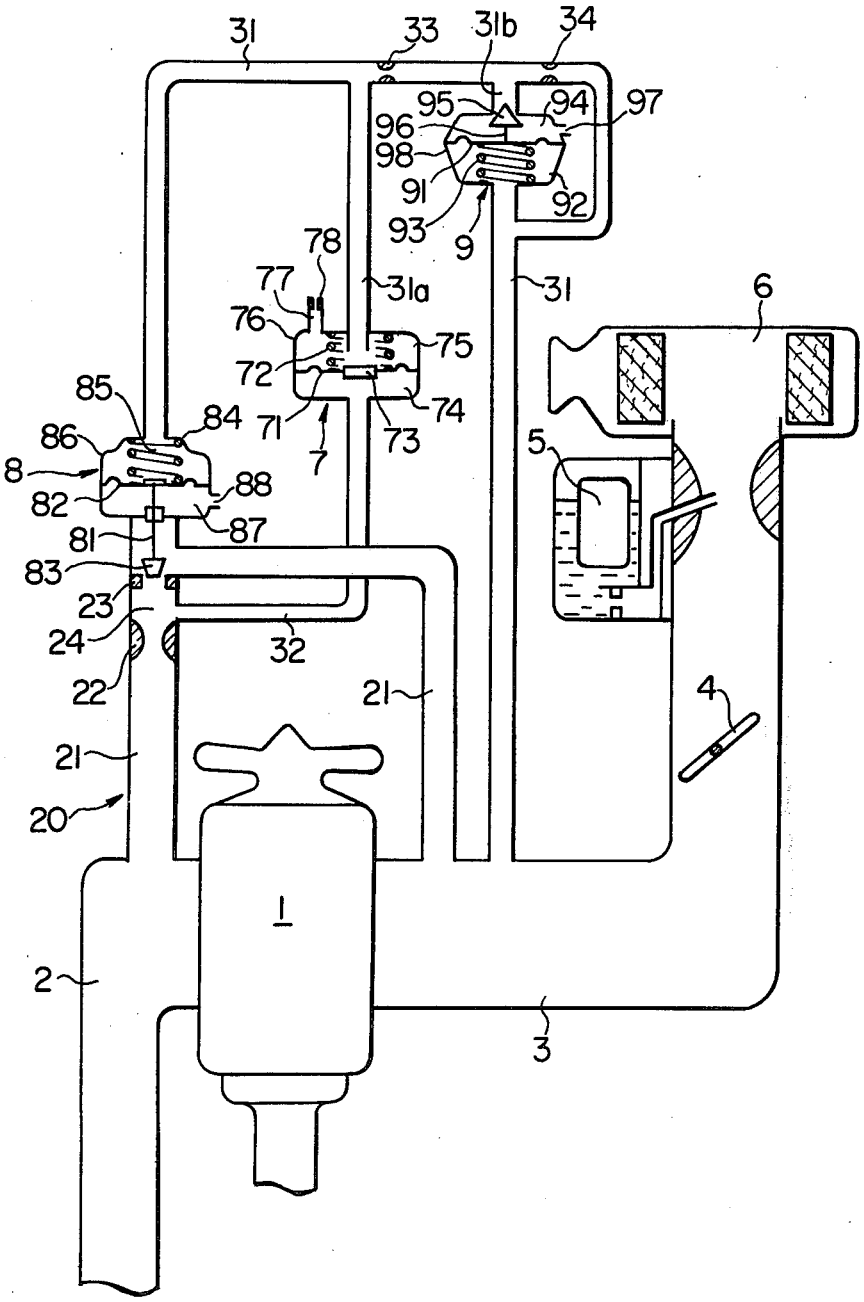
FIG. 3 is a schematic view of a preferred embodiment of the present invention.

The present invention has for its object to provide an exhaust gas recirculation system for an internal combustion engine which may attain the ideal control of the external exhaust gas recirculation ratio as shown in FIG. 2 as will be described in detail with reference to one preferred embodiment thereof as shown in FIG. 3.

Referring to FIG. 3, an internal combustion engine proper 1 is provided with an exhaust tube 2 and an intake tube 3 which has a throttle valve 5 and a carburetor 5 and is connected to an air cleaner 6 at the upstream end thereof.

An exhaust gas recirculation system generally indicated by the reference numeral 20 includes a recirculation tube 21 which constitutes an exhaust gas recirculation passage and a control valve 8. One end of the recirculation tube 21 is connected to the exhaust tube 2 while the other end is connected to the intake tube 3 at a position downstream of the throttle valve 4. A restriction 22 and a valve seat 23 are disposed within the recirculation tube 21 between the control valve 8 and the exhaust tube 2, and they define a pressure chamber 24. The control valve 8 has a valve body 83 which cooperates with the valve seat 23 to provide a variable orifice.

The control valve 8 has a housing 86 and a diaphragm 82 which divides the housing 86 into two first and second pressure chambers 85 and 87. The first or upper pressure chamber 85 receives a pressure signal which is controlled by a modulator 7 and transmitted through a first pressure pipe 31. Surrounding air is introduced into the second or lower pressure chamber 87 through an air intlet port 88. The valve body 83 is connected to the diaphragm 82 with a shaft 81. A spring 84 which is loaded within the first pressure chamber 85 normally biases the valve body 83 toward the valve seat 23.

The modulator 7 has a housing 76 and a diaphragm 71 which divides the housing 76 into third and fourth pressure chambers 74 and 75. The third or lower pressure chamber 74 of the modulator 7 is communicated with the pressure chamber 24 through a second pressure pipe 32. Within the fourth pressure chamber 75 is loaded a spring 72 which normally biases the diaphragm 71 downward, and the fourth pressure chamber 75 is communicated with the surrounding atmosphere through an inlet port 77 having a restriction 78. The upper or fourth pressure chamber 75 is further communicated with the first pressure pipe 31 through a branch pipe **31*a* so that the pressure in the fourth pressure chamber 75 of the modulator 7 is bled into the first pressure pipe 31 to control the pressure signal to be transmitted to the first pressure chamber 85 of the control valve 8. Within the first pressure pipe 31 is further disposed a restriction 33 upstream of the junction with the branch pipe 31*a*. As the diaphragm 71 is deflected, a valve body 73 mounted thereon opens or closes the lower end of the branched pipe 31*a***.

Figure 4:
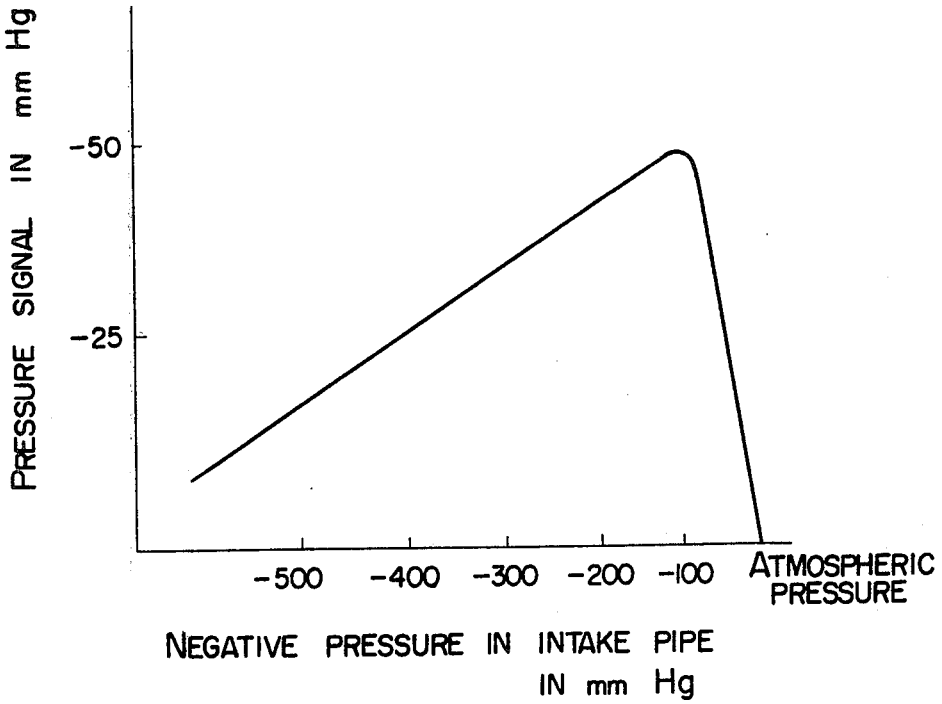
FIG. 4 shows the pressure-signal vs. intake pressure characteristic curve used for the explanation of the mode of operation of the exhaust gas recirculation system shown in FIG. 3.

A negative pressure control valve 9 has a housing 98 and a diaphragm 91 which divides the housing 98 into fifth and sixth pressure chamber 92 and 94. The fifth or lower pressure chamber 92 is communicated through the first pressure pipe 31 with the intake tube 3 so that the negative pressure is admitted into the lower pressure chamber 92. A spring 93 is loaded within the lower or fifth pressure chamber 92 so that the diaphragm 91 is normally biased upward. A valve body 95 is connected to the diaphragm 91 with a shaft 96. The upper or sixth pressure chamber 94 is communicated not only with the surrounding atmosphere through an inlet port 97 but also with the first pressure pipe 31 through a branch pipe **31*b* branched therefrom. A restriction 34 is disposed within the first pressure pipe 31 between the junctions with the blanch pipe 31*b* and the fifth pressure chamber 92. As the diaphragm 91 is deflected the valve body 95 moves toward or away from the lower end opening of the branched pipe 31*b*, thereby controlling the degree of opening and hence the volume of the atmospheric air to be bled into the first pressure pipe 31. Thus the negative pressure signal to be transmitted through the first pressure pipe 31 to the modulator 7 and the control valve 8** may be controlled as indicated in FIG. 4.

Next the mode of operation will be described. The volume of air taken into the intake tube 3 is dependent upon the degree of opening of the throttle valve 4. Intake air is mixed with the fuel ejected from the carburetor 5, and the air-fuel mixture is charged into the combustion chambers in the engine 1. Exhaust gases are discharged through the exhaust tube 2 into the surrounding atmosphere.

Assume that the restriction 78 is not disposed within the inlet port 77 of the fourth or upper pressure chamber 75 of the modulator 7 so that the pressure within the upper pressue chamber 75 be always equal to the atmospheric pressure. Then the diaphragm 82 in the control valve 8 is deflected downwardly under the force of the bias spring 84 so that the valve body 83 which is connected to the diaphragm 82 with the shaft 81 is pressed against the valve seat 23, whereby the recirculation passage 21 is closed. As a result the pressure in the pressure chamber 24 is equal to the exhaust gas pressure $P_{EX}$ (which in turn is dependent upon the volume of intake air because the volume of intake air is in proportion to the volume of exhaust gases). The exhaust gas pressure $P_{EX}$ is transmitted through the second pressure pipe 32 to the third or lower pressure chamber 74 in the modulator 7. The exhaust gas pressure $P_{EX}$ overcomes the force of the spring 72 of the modulator 7 so that the diaphragm 71 is deflected upward and consequently the degree of opening of the lower end of the branched pipe **31*a* is reduced. Then the volume of atmospheric air to be bled through the first branched pipe 31*a* into the first pressure pipe 31 is reduced so that the pressure signal admitted through the first pressure pipe 31 into the first or upper pressure chamber 85 of the control valve 8 gradually approaches in magnitude to the pressure controlled by the negative pressure control valve 9**.

As a result, the diaphragm 82 of the control valve 8 is deflected upward against the bias spring 84 so that the valve body 83 which is connected with the shaft 81 to the diaphragm 82 is moved away from the valve seat 23 upwardly and consequently the degree of opening of the valve seat 23 is increased. As a consequence the exhaust gases in the pressure chamber 24 is recirculated into the intake tube 3. When the exhaust gases to be recirculated flow past the restriction 22, the pressure drop results so that the pressure in the pressure chamber 24 is lower than the exhaust gas pressure $P_{EX}$.

When the pressure within the pressure chamber 24 is overcomed by the force of the bias spring 72 in the modulator 7, the diaphragm 71 is deflected downward so that the atmospheric air to be bled through the first branched pipe 31*a* into the first pressure pipe 31 is increased in volume. As a result, the pressure signal transmitted through the first pressure pipe 31 to the first or upper chamber 85 of the control valve 8 drops in the degree of negative pressure so that the diaphragm 82 is deflected downward and consequently the valve body 83 moves close to the valve seat 23 thereby reducing the degree of opening thereof. Then the flow rate of the exhaust gases to be recirculated is reduced so that the pressure drop across the restriction 22 is reduced and consequently the pressure in the pressure chamber 24 is increased. Thus, the pressure within the pressure chamber 24 would be controlled at a predetermined level according to the force of the bias spring 72 of the modulator 7.

It is well known to those skilled in the art that when the pressure within the fourth or upper pressure chamber 75 of the modulator 7 is maintained constant and when the negative pressure control valve 9 is eliminated so that the first pressure pipe 31 is directly communicated with the intake tube 3, the pressure in the pressure chamber 24 may be maintained constant so that the volume of the exhaust gases recirculated is in proportion to the volume of intake air. However according to the present invention the intake tube 3 and the first pressure pipe 31 intercommunicate through the negative pressure control valve 9 so that the magnitude of the negative pressure signal admitted into the fourth or upper pressure chamber 75 of the modulator 7 may be in proportion to the load. Furthermore the restriction 78 is disposed in the inlet port 77 so that the negative pressure signal in proportion to the load may remain within the fourth or upper pressure chamber 75. Thus the pressure in the pressure chamber 24 may be controlled depending upon the load and consequently the volume of exhaust gases to be recirculated may be controlled depending upon the load as will be described in more detail hereinafter.

According to the present invention, the negative pressure in the intake tube 3 is admitted through the first pressure pipe 31 into the fifth or lower pressure chamber 92 of the negative pressure control valve 9 so that the diaphragm 91 is deflected downward against the spring 93. Then the valve body 95 which is connected to the diaphragm 91 with the shaft 96 is moved downward away from the lower end of the branched pipe 31*b*. That is, the degree of opening of the lower end of the 31*pipe 31i b* is controlled depending upon the negative pressure in the intake tube 3. The higher the negative pressure the higher the degree of opening becomes, and vice versa. Since the volume of the air to be bled into the first pressure pipe 31 is dependent upon the degree of opening of the lower end of the branched pipe 31*b*, the negative pressure control valve 9 produces the negative pressure signal as shown in FIG. 4, and the pressure signal is transmitted through the restriction 33 in the first pressure pipe 31 into the modulator 7 and the control valve 8.

The magnitude of the negative pressure signal which is controlled by the negative pressure control valve 9 is in proportion to the load. That is, when the pressure in the intake tube 3 is high; that is, when the load is light, the negative pressure signal is low in magnitude. On the other hand, when the intake air pressure is low; that is, when the load is heavy, the magnitude of the negative pressure signal is high.

Since the restriction 78 is disposed in the inlet port 77 of the modulator 7, the volume of the atmospheric air introduced into the fourth or upper pressure chamber 75 is less 50 that the negative pressure signal admitted therein from the negative pressure signal control valve 9 may remain and may be maintained in proportion to the magnitude of the negative pressure signal or the load.

This mode of operation of the exhaust gas recirculation system will be described theoretically. The quantity $Q_{EGR}$ of the recirculated exhaust gases is expressed by $$Q_{EGR} = C \cdot A\sqrt{P_{EX} - \Delta P} \quad (1)$$

where

C = flow coefficient,

A = area of the restriction 22, $P_{EX}$ = exhaust gas pressure, and $\Delta P$ = pressure in the pressure chamber 24.

The pressure $\Delta P$ is dependent upon the set load W of the bias spring 72, the pressure receiving area A1 of the diaphrgam 71 and the pressure Pe in the fourth or upper pressure chamber 75 of the modulator. That is, $$Al \times \Delta P = W + Al \times Pe$$

Therefore $$\Delta P = \frac{W}{Al} + Pe.$$

Substituting this into Eq. (1), we have $$Q_{EGR} = C \cdot A\sqrt{P_{EX} - (\frac{W}{Al} + Pe)}$$

In the conventional exhaust gas recirculation systems, the pressure Pe is always maintained equal to the atmospheric pressure so that the quantity of recirculated gases is in proportion to the volume of intake air. That is, the external exhaust gas recirculation ratio is constant. However according to the present invention, the pressure Pe is controlled in response to the load so that the external exhaust gas recirculation ratio may become low with a light load and become high with a heavy load. Thus the external exhaust gas recirculation ratio may be controlled in an ideal manner as shown in FIG. 2.

As described above, the exhaust gas recirculation system in accordance with the present invention not only utilizes the exhaust gas pressure in proportion to the volume of intake air so that the quantity of exhaust gases to be recirculated is made proportional to the volume of intake air but also controls the volume of exhaust gases to be recirculated depending upon the load such that the exhaust gas recirculation ratio is increased or decreased depending upon the increased or decreased load. Therefore the external exhaust gas recirculation ratio may be controlled in an ideal manner relative to the internal exhaust gas recirculation ratio so that the remarkable reduction in NOx emission may be attained.

Furthermore the negative pressure in the pressure chamber of the modulator may be correctly and positively made proportional to the negative pressure which is controlled by the negative pressure control valve so that the control of the recirculation, depending upon load may be accomplished with a higher degree of accuracy.

What is claimed is:

1. An exhaust gas recirculation system for an internal combustion engine comprising (a) an exhaust gas recirculation passage communicating an exhaust tube of the engine with an intake tube of the engine at a position downstream of a throttle valve disposed therein for recirculating part of exhaust gases into said intake tube for said exhaust tube, (b) means for producing a pressure signal the magnitude of which is in proportion to the load on said internal combustion engine, (c) a control valve having a pressure chamber communicated with said pressure signal producing means through a pressure pipe so as to control the flow rate of the exhaust gases to be recirculated through said exhaust gas recirculation passage in response to the variations in pressure in said pressure chamber, and (d) modulator means for controlling the pressure signal produced by said pressure signal producing means, said modulator means comprising a housing, a diaphragm disposed within said housing so as to define first and second pressure chamber above and below said diaphragm within said housing, said second pressure chamber being communicated with a pressure chamber defined in said exhaust gas recirculation passage upstream of said control valve, said first pressure chamber being communicated with said pressure pipe, a bias spring loaded in said first pressure chamber for biasing said diaphragm toward said second pressure chamber, valve means operatively connected to said diaphragm for controlling the communication between said first pressure chamber and said pressure pipe, an inlet port for comminicating said first pressure chamber with the surrounding atmosphere, and fixed restriction means disposed within said inlet port for maintaining the pressure within said first pressure chamber in proportion to the magnitude of the pressure signal passing through said pressure pipe.

2. An exhaust gas recirculation system as set forth in claim 1 wherein said pressure signal producing means comprises a housing, a diaphragm disposed within said housing so as to define first and second pressure chambers above and below said diaphragm within said housing, said second pressure chamber of said pressure signal producing means being communicated with said intake tube downstream of said throttle valve disposed therein, said first pressure chamber of said pressure signal producing means being communicated with said pressure pipe, a bias spring disposed within said second pressure chamber of said pressure signal producing means for biasing said associated diaphragm toward said first pressure chamber, valve means operatively connected to said diaphragm of said pressure signal producing means for controlling the communication between said first pressure chamber of said pressure signal producing means and said pressure pipe, an inlet port for communicating said first pressure chamber of said pressure signal producing means with the surrounding atmosphere, and bypass passage means including fixed restriction means for communicating said second pressure chamber of said pressure signal producing means with said pressure pipe.

3. An exhaust gas recirculation system for an internal combustion engine comprising:

an exhaust gas recirculation passage communicating an exhaust tube of an engine with an intake tube of said engine at a position downstream of a throttle valve disposed in said intake tube for recirculating part of exhaust gases into said intake tube;

a restriction and a valve seat respectively disposed in series in said exhaust gas recirculation passage for forming a pressure chamber in said exhaust gas recirculation passage between said restriction and said valve seat;

a control valve having a pressure chamber, a deformable diaphragm responsive to the pressure in said pressure chamber of said control valve, and a valve body connected to said diaphragm cooperating with said valve seat to form a variable orifice;

a pressure pipe communicating said pressure chamber of said control valve with said intake tube downstream of said throttle valve for applying the negative pressure in said intake tube to said pressure chamber in said control valve; and a modulator for controlling the magnitude of the negative pressure in said pressure chamber of said control valve in response to the pressure in said pressure chamber in said exhaust gas recirculation passage, whereby the amount of exhaust gases to be recirculated is responsive to an amount of air introduced into said engine, wherein the improvement comprises:

a negative pressure control valve for controlling the magnitude of the negative pressure in said pressure chamber of said control valve in response to the intake vacuum in said intake tube;

means for making said modulator also responsive to the magnitude of the negative pressure controlled by said negative pressure control valve so that the amount of exhaust gas to be recirculated is also responsive to the intake vacuum.

4. An exhaust gas recirculation system as set forth in claim 3, wherein said modulator comprises:

a housing;

a diaphragm disposed in said housing to form pressure chambers at both sides thereof, one of said pressure chambers being communicated with said pressure chamber in said exhaust gas recirculation passage, and the other being communicated with the atmosphere through a restriction;

a first branch pipe communicated at one end with said pressure chamber of said control valve, the other end of said branch pipe opening to said other chamber of said modulator; and a valve body secured to said diaphragm for cooperating with said other end of said first branch pipe so as to control the opening area of said other end of said first branch pipe in response to the pressure in said pressure chamber in said exhaust gas recirculation passage.

5. An exhaust gas recirculation system as set forth in claim 3, wherein said pressure pipe is provided with a pair of restrictions disposed in said pressure pipe in series, and wherein said negative pressure control valve comprises:

a housing;

a diaphragm disposed in said housing to form pressure chambers at both sides thereof, one of said pressure chambers being communicated with said intake tube downstream of said throttle valve, and the other being communicated with the atmosphere;

a second branch pipe communicated at one end with said pressure pipe between said pair of restrictions, the other end of second branch pipe opening to said other chamber of said negative pressure control valve; and a valve body, connected to said diaphragm for cooperating with said other end of said second branch pipe so as to control the opening area of said other end of said second branch pipe in response to the intake vacuum introduced from said intake tube into said pressure chamber of said negative pressure control valve.

6. An exhaust gas recirculation system as set forth in claim 3, wherein:

said modulator comprises a housing, a diaphragm disposed within said housing so as to define first and second pressure chambers above and below said diaphragm within said housing, said second pressure chamber being communicated with said pressure chamber in said exhaust gas recirculation passage, said first pressure chamber being communicated with said pressure pipe, a bias spring loaded in said first pressure chamber for biasing said diaphragm toward said second pressure chamber, valve means operatively connected to said diaphragm for controlling the communication between said first pressure chamber and said pressure pipe, an inlet port for communicating said first pressure chamber with the surrounding atmosphere, and fixed restriction means disposed within said inlet port for maintaining the pressure within said first pressure chamber in proportion to the magnitude of the negative pressure in said pressure pipe.

* * * * *